US011401614B2

(12) United States Patent
Okubo et al.

(10) Patent No.: US 11,401,614 B2
(45) Date of Patent: Aug. 2, 2022

(54) ELECTROLYTIC CELL FOR PRODUCING NITROGEN TRIFLUORIDE GAS AND PARTITION THEREFOR

(71) Applicant: KANTO DENKA KOGYO CO., LTD., Tokyo (JP)

(72) Inventors: Kimitaka Okubo, Shibukawa (JP); Shujiro Imao, Tokyo (JP)

(73) Assignee: KANTO DENKA KOGYO CO., LTD., Tokyo (JP)

( * ) Notice: Subject to any disclaimer, the term of this patent is extended or adjusted under 35 U.S.C. 154(b) by 194 days.

(21) Appl. No.: 16/646,064

(22) PCT Filed: Oct. 24, 2018

(86) PCT No.: PCT/JP2018/039437

§ 371 (c)(1),
(2) Date: Mar. 10, 2020

(87) PCT Pub. No.: WO2019/087885

PCT Pub. Date: May 9, 2019

(65) Prior Publication Data

US 2020/0283917 A1 Sep. 10, 2020

(30) Foreign Application Priority Data

Oct. 31, 2017 (JP) ..... JP2017-210133

(51) Int. Cl.

| | |
|---|---|
| ***C25B 15/02*** | (2021.01) |
| ***C25B 1/245*** | (2021.01) |
| ***C25B 13/02*** | (2006.01) |
| ***C25B 9/19*** | (2021.01) |

(52) U.S. Cl.
CPC ..... *C25B 1/245* (2013.01); *C25B 9/19* (2021.01); *C25B 13/02* (2013.01)

(58) Field of Classification Search
CPC ..... C25B 1/245; C25B 15/02; C25B 9/00; C25B 11/02; C25B 9/17; C25B 9/19; C25B 15/00; C25B 9/77
See application file for complete search history.

(56) References Cited

U.S. PATENT DOCUMENTS

2008/0314759 A1 12/2008 Furuta et al.

FOREIGN PATENT DOCUMENTS

| | | | |
|---|---|---|---|
| CN | 103635609 | A | 3/2014 |
| EP | 2 093 310 | A1 | 8/2009 |
| EP | 2 860 287 | A1 | 4/2015 |
| JP | S63-130790 | A | 6/1988 |
| JP | H03-249189 | A | 11/1991 |
| JP | 2000-104188 | A | 4/2000 |

(Continued)

OTHER PUBLICATIONS

International Search Report, dated Jan. 22, 2019, from corresponding PCT application No. PCT/JP2018/039437.

*Primary Examiner* — Zulmariam Mendez
(74) *Attorney, Agent, or Firm* — Nixon & Vanderhye

(57) ABSTRACT

An electrolytic cell has a partition that covers an upper region of one electrode of an anode and a cathode in order to separate a gas generated from the anode and a gas generated from the cathode from each other. The partition has wall surfaces that are each opposite a surface of the electrode. The wall surfaces have, in lower end-side regions thereof, ribs extending in a direction that has a lateral direction component. The ribs and the partition are made of a fluororesin and are integrally formed.

21 Claims, 4 Drawing Sheets

(56) References Cited

FOREIGN PATENT DOCUMENTS

| | | | |
|---|---|---|---|
| JP | 2006-336035 | A | 12/2006 |
| JP | 2008-240058 | A | 10/2008 |
| JP | 2013-027090 | A | 2/2013 |
| KR | 10-2003-0015667 | A | 2/2003 |
| KR | 20170040109 | A | 4/2017 |
| WO | 2013/001800 | A1 | 1/2013 |

ELECTROLYTIC CELL FOR PRODUCING NITROGEN TRIFLUORIDE GAS AND PARTITION THEREFOR

TECHNICAL FIELD

The present invention relates to an electrolytic cell for producing nitrogen trifluoride gas and a partition for use in the electrolytic cell.

BACKGROUND ART

Conventionally, a method for producing nitrogen trifluoride by electrolysis is known. To electrolytically produce nitrogen trifluoride, for example, a method is known in which nitrogen trifluoride is produced by ammonium fluoride-hydrogen fluoride molten salt electrolysis as shown in the following reaction formulae.

(Anode) $NH_4^+ + 7F^- \rightarrow NF_3 + 4HF + 6e^-$ (Cathode) $6H^+ + 6e^- \rightarrow 3H_2$ As shown in the reaction formulae above, in the electrolytic production of nitrogen trifluoride, nitrogen trifluoride is generated from an anode, and hydrogen gas is generated from a cathode. If the two gases mix, it may cause explosion hazard.

To address this issue, conventionally, a partition plate for preventing nitrogen trifluoride generated from the anode and hydrogen gas generated from the cathode from mixing is provided in an electrolytic cell.

For example, Patent Literature 1 discloses an electrolytic cell in which a nickel plate or a fluororesin plate is welded to a perimeter of a lower end of a resin partition plate for separating a gas generated from an anode and a gas generated from a cathode from each other.

Patent Literature 2 discloses a collector that is provided in an electrolytic cell for producing nitrogen trifluoride, in order to surround an electrode, wherein a reinforcing ring joint in which a metal ring for reinforcement can be inserted is provided on a lower side thereof, and the reinforcing ring is secured to the reinforcing ring joint.

CITATION LIST

Patent Literature

Patent Literature 1: JP 2006-336035A
Patent Literature 2: KR 10-2017-0040109A

SUMMARY OF INVENTION

To electrolytically produce nitrogen trifluoride, usually, a partition is immersed in an electrolyte at a high temperature for a long period of time. For this reason, there is the problem in that as the operating time of the electrolytic cell increases, an immersed portion of the partition deforms, and the partition becomes no longer able to exhibit its effects.

According to Patent Literature 1, the resin partition plate is reinforced by providing the resin partition plate with a reinforcing plate material by welding. However, in the case where a nickel plate is used as the reinforcing material, it is not possible to completely suppress permeation of the electrolyte through a welded part and the resin partition plate material itself, and there is a risk that a long operating time will cause corrosion of the reinforcing nickel plate and will generate gas, and the resin partition plate will deform. In the case where a fluororesin plate is used as the reinforcing material as well, there is a risk that deformation will be caused by the penetration of the electrolyte through the welded part and the resin partition plate material itself.

Furthermore, with the shape of the reinforcing ring joint disclosed in Patent Literature 2, the reinforcing effect is limited. Moreover, in the case where a structure in which a metal ring is inserted inside is formed as disclosed in Patent Literature 2 as well, there is a risk that corrosion of the metal ring, and gas generation, due to permeation of the electrolyte from a ring insertion opening will cause deformation of a reinforcing part.

An object of the present invention is to provide an electrolytic cell and a partition that address the problems with a conventional method such as those described above.

The inventors of the present invention have conducted in-depth research so as to achieve the above-described object, and found that, in an electrolytic cell for producing nitrogen trifluoride, as a result of a partition made of a fluororesin being provided with a rib that is integrally formed with the partition, the risk of corrosion is eliminated, and the deformation of the partition is effectively suppressed, so that the electrolytic cell can be stably operated for a long period of time.

The present invention was accomplished based on the above-described findings, and provides an electrolytic cell for producing nitrogen trifluoride gas, including:

a partition that covers an upper region of one electrode of a cathode and an anode in order to separate a gas generated from the anode and a gas generated from the cathode from each other, wherein the partition has a wall surface that is opposite a surface of the electrode, the wall surface has, in a lower end-side region thereof, a rib extending in a direction that has a lateral direction component, and the rib and the partition are made of a fluororesin and are integrally formed.

Also, the present invention provides a partition for an electrolytic cell for producing nitrogen trifluoride gas, the partition being configured to be used to cover an upper region of one electrode of an anode and a cathode of the electrolytic cell for producing nitrogen trifluoride gas, wherein the partition is used with one end side thereof being fixed to an upper portion of the electrolytic cell, and has, on a wall surface on another end side thereof, a rib extending in a direction that has a direction component that is perpendicular to a direction in which the two end portions are opposite each other, and the partition is made of a fluororesin and is integrally formed with the rib.

DESCRIPTION OF EMBODIMENTS

Hereinafter, preferred embodiments of an electrolytic cell and a partition of the present invention will be described in detail based on the drawings. The scope of the present invention is not restricted to that which will be described below, and changes can be made thereto without departing from the gist of the present invention.

An electrolytic cell of the present invention is used to produce nitrogen trifluoride. Nitrogen trifluoride is obtained by a process of electrolytically fluorinating an ammonium salt such as ammonium fluoride.

Figure 1:
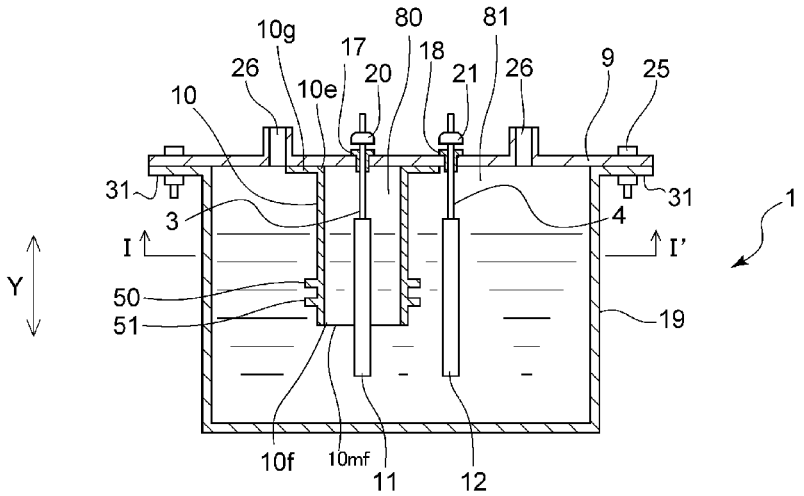
FIG. 1 is a vertical cross-sectional view showing an example of an electrolytic cell, which is an embodiment of the present invention.

FIG. 1 shows an embodiment of the electrolytic cell of the present invention.

As shown in FIG. 1, an electrolytic cell 1 has an anode 11 and a cathode 12. An anode connecting rod 3 and a cathode connecting rod 4 are attached to the anode 11 and the cathode 12, respectively. The anode connecting rod 3 and the cathode connecting rod 4 are fixed to an electrolytic cell lid 9 with use of respective fixing cap nuts 20 and 21. The lid 9 is insulated from the anode 11 and the cathode 12 by insulators 17 and 18. Moreover, the lid 9 is detachably fixed to a flange 31 with use of bolts and nuts 25, the flange 31 extending outward from an opening portion of an electrolytic cell main body 19. The shape of the electrolytic cell lid 9 is not limited to a shape that defines a flat top surface such as that shown in FIG. 1, and can be any shape that allows for providing the lid 9 with a partition and thereby preventing gases generated from the anode 11 and the cathode 12 in the electrolytic cell from mixing.

Figure 2:
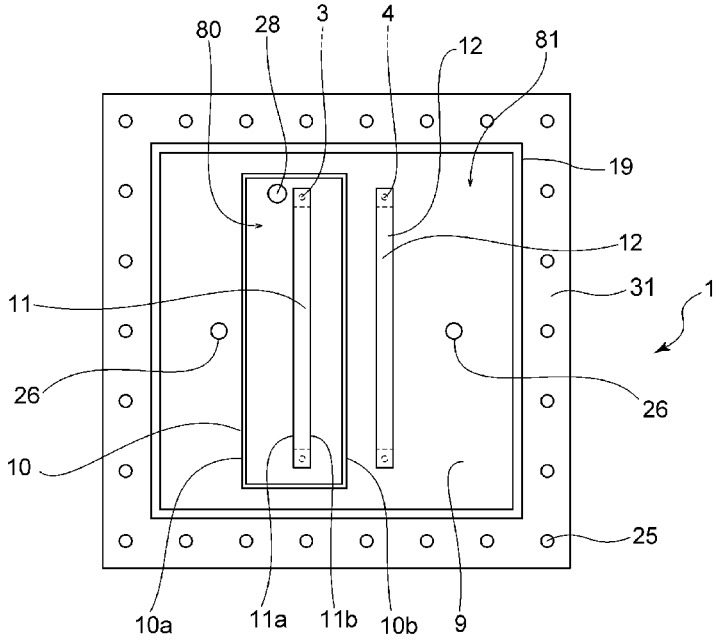
FIG. 2 shows the electrolytic cell when viewed in the direction of arrows I-I' in FIG. 1.

As shown in FIGS. 1 and 2, the electrolytic cell 1 is provided with a partition 10 for preventing a gas generated from the anode 11 and a gas generated from the cathode 12 from mixing.

The partition 10 has a tubular shape that has a hollow portion inside, and is arranged in the electrolytic cell 1 with an end portion 10*e* side located on one side of the tubular shape in the axial direction thereof being fixed to the lid 9. The partition 10 may also have a flange 10*g* in its upper end portion 10*e*, and the partition 10 may be attached to the lid 9 by fixing the flange 10*g* to an upper or lower surface of the lid 9. In the following description, the end portion 10*e* that is fixed to the lid 9 may also be referred to as the fixed end portion 10*e* or the upper end portion 10*e*. A region of the partition 10 on an end portion 10*f* side located on the other side in the axial direction is immersed in an electrolytic solution without being fixed by another member. This end portion 10*f* may also be referred to as the free end portion or the lower end portion. In FIG. 1, the vertical direction Y, which will be described later, is a direction in which the end portion 10*e* and the end portion 10*f* of the partition 10 are opposite each other.

The partition 10 covers an upper region of one electrode of the anode 11 and the cathode 12. In the present embodiment, the partition 10 covers the anode 11. In this specification, covering preferably refers to covering an object in a state in which the partition 10 is spaced apart from the covered object, rather than covering the object while being in direct contact therewith. As long as the partition 10 has the function of preventing the gas generated from the anode 11 and the gas generated from the cathode 12 from mixing, the partition 10 may cover only a portion of the upper region of one electrode of the cathode 12 and the anode 11, or may cover the entire upper region of the relevant electrode. In the present embodiment, the partition 10 is detachably arranged on the lid 9, but the present invention is not limited to this, and the partition 10 may also be integrally molded with a lid and thus be undetachable therefrom.

As shown in FIGS. 1 and 2, a gas phase in an upper portion of the electrolytic cell 1 is divided into a gas phase 80 in which the gas generated from the anode 11 is present and a cathode gas phase 81 in which the gas generated from the cathode 12 is present, by the partition 10 constituting a partition between the anode 11 and the cathode 12. When performing electrolysis, it is also possible to introduce an inert gas, such as nitrogen gas ($N_2$), as a diluted gas into the anode gas phase 80 and the cathode gas phase 81, which are separated from each other by the partition 10. With regard to the generated nitrogen trifluoride gas, which is the gas generated from the anode, and the generated hydrogen gas, which is the gas generated from the cathode, the cathode gas is discharged from cathode gas generation outlet tubes 26 provided in the electrolytic cell lid 9 to a cathode gas outlet line (not shown), and the anode gas is discharged from an anode gas generation outlet tube 28 to an anode gas outlet line (not shown).

In the example shown in FIG. 2, the partition 10 surrounds the anode 11 in a peripheral direction thereof, when viewed in the vertical direction (direction Y in FIG. 1). Specifically, the partition 10 has a rectangular shape when viewed from below in the vertical direction (direction Y in FIG. 1). However, the partition 10 is not limited to this configuration as long as the partition 10 partitions an upper region of the electrolytic cell so that the cathode 12 and the anode 11 are separated from each other. For example, the partition 10 may be plate-shaped and separate the cathode 12 and the anode 11 from each other, or may surround the cathode 12 instead of the anode 11.

As shown in FIGS. 1 and 2, the partition 10 surrounds an upper region of the anode 11, and the partition 10 has ribs 50 and 51 on surfaces 10*a* and 10*b* of the walls that are opposite respective surfaces 11*a* and 11*b* of the anode 11 surrounded by the partition 10. The shape of the anode 11 and the cathode 12 is not limited, but as shown in FIG. 1, the anode 11 and the cathode 12 usually have a polygonal shape when viewed from below the electrolytic cell in the vertical direction Y. It is preferable that the partition 10 has the ribs 50 and 51 on a wall surface thereof that is parallel to a surface of an electrode (anode 11 in the present embodiment) that is surrounded by the partition 10, because, with this configuration, a high deformation-preventing effect is obtained.

Figure 3:
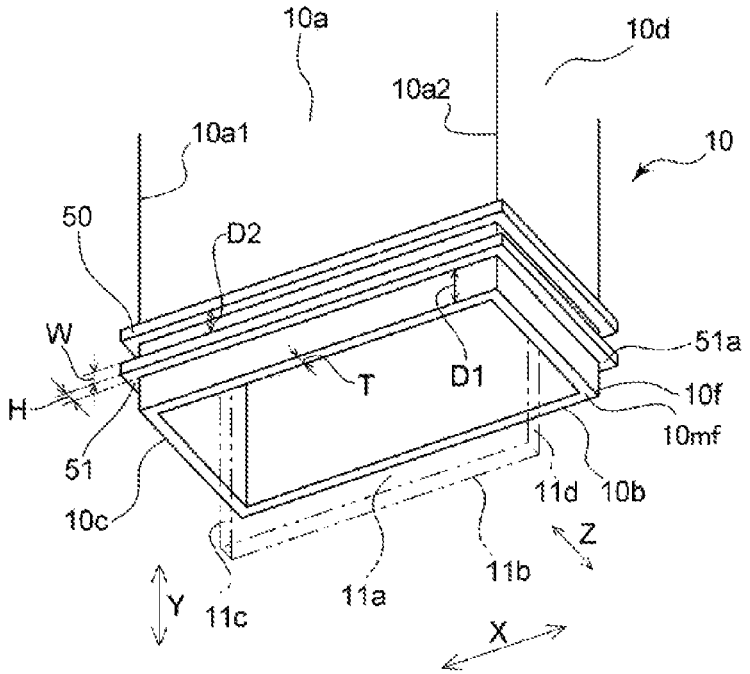
FIG. 3 is a perspective view of a partition in FIG. 1 when viewed from below.

For example, in an example shown in FIG. 3, the anode 11 has a rectangular parallelepiped shape, and the edges of this rectangular parallelepiped extend, within the electrolytic cell 1, in the vertical direction Y, a thickness direction Z that is orthogonal to the vertical direction Y, and a width direction X that is orthogonal to the thickness direction Z and the vertical direction Y. The size of the anode 11 in the width direction X is larger than the size thereof in the thickness direction Z. Preferably, the anode 11 is plate-shaped. In the following description, among the surfaces of the rectangular parallelepiped anode 11, the surfaces surrounded by the edges extending in the vertical direction Y and the edges extending in the width direction X will be referred to as plate surfaces of the anode 11, the surfaces surrounded by the edges extending in the vertical direction Y and the edges extending in the thickness direction Z will be referred to as side surfaces of the anode 11, and the surfaces surrounded by the edges extending in the width direction X and the edges extending in the thickness direction Z will be referred to as upper and lower surfaces, respectively, of the anode 11.

In the present embodiment, the partition 10 has the ribs 50 and 51 on each of the pair of surfaces 10*a* and 10*b* of the walls that are opposite the plate surfaces 11*a* and 11*b*, respectively. It is preferable that the surfaces 10*a* and 10*b* of the partition 10 are parallel to the plate surfaces 11*a* and 11*b* of the anode 11. Note that although the shape of the anode 11 has been described above, the cathode 12 may also have a similar shape.

The ribs 50 and 51, as well as the partition 10, are made of a fluororesin. Thus, their shapes can be stably maintained at high temperatures for a long period of time without being eroded by the electrolyte. For example, any of polytetrafluoroethylene (PTFE), perfluoroalkoxy alkane (PFA), polychlorotrifluoroethylene, polyvinylidene fluoride, polyvinyl fluoride, a tetrafluoroethylene-hexafluoropropylene copolymer, a tetrafluoroethylene-ethylene copolymer, a chlorotrifluoroethylene-ethylene copolymer, and the like can be used as the fluororesin.

The ribs 50 and 51, as well as the partition 10, are integrally formed. Being integrally formed means that the ribs 50 and 51, as well as the partition 10, are made of the same material and formed into a same continuous member with no gaps. Even if the ribs 50 and 51, as well as the partition 10, are made of the same material, a case where the ribs 50 and 51 are joined to the partition 10 by using an adhesive and a case where the ribs 50 and 51 are welded or fusion-bonded to the partition 10 are not included in the present invention. An example in which the ribs 50 and 51, as well as the partition 10, are integrally formed is a state in which the ribs 50 and 51, as well as the partition 10, are integrally molded by using a single mold.

As shown in FIG. 3, the ribs 50 and 51 on the wall surfaces 10*a* and 10*b* are arranged in lower end-side regions of the wall surfaces 10*a* and 10*b* and extend in a direction that has a lateral direction component. As used herein, the lateral direction and the direction that has a lateral direction component refer to directions that extend along the wall surfaces on which the ribs 50 and 51 are formed. The lateral direction is a direction that extends along the wall surfaces on which the ribs 50 and 51 are formed and that is orthogonal to the vertical direction Y. The direction that has a lateral direction component includes, in addition to the lateral direction, directions other than the vertical direction Y, such as an obliquely upward direction and an obliquely downward direction, as shown in FIG. 7, for example. The angle between the direction that has a lateral direction component and the lateral direction is preferably 45° or less, or more preferably 30° or less. In the example shown in FIG. 3, the ribs 50 and 51 extend in the lateral direction, and the same applies to embodiments shown in FIGS. 4, 5, and 6.

The ribs 50 and 51 each independently extend continuously from one end to the other end, in the lateral direction, of a wall surface on which the rib is formed. However, the ribs 50 and 51 may also extend intermittently in the lateral direction on the wall surfaces of the partition 10. Extending intermittently means that one or two or more gap are present. Moreover, with respect to the locations where the ribs 50 and 51 are present, each rib may extend over the entire length, in the lateral direction, of a wall surface on which the rib is formed, or may extend over only a portion of the lateral length of that wall surface. For example, the ribs 50 and 51 on one wall surface of the partition 10 may extend to end portion (e.g., end portion 10*a*1 and 10*a*2 in the case of the wall surface 10*a*, see FIG. 3) of that wall surface of the partition 10 in the lateral direction, or may extend only to positions inward of the end portions of the wall surface in the lateral direction, without reaching the end portions of the wall surface.

From the standpoint of increasing the deformation-preventing effect, it is preferable that when the partition 10 has a shape that surrounds the anode 11, the ribs 50 and 51 also surround the anode 11 along an outer or inner perimeter of the partition 10. In this case, the ribs 50 and 51 also extend in a direction that includes a lateral direction component in lower end-side regions of the side surfaces of the partition 10, or, for example, surfaces 10*c* and 10*d* of the walls that are opposite the side surfaces 11*c* and 11*d* of the anode 11 in FIG. 3. Most preferably, the partition 10 surrounds the entire perimeter of the anode 11, and ribs are provided extending over the entire perimeter of the partition 10.

It is preferable that the ratio (W/T) of the width W (see FIG. 3) of each of the ribs 50 and 51 to the thickness T (see FIG. 3) of the partition 10 is from 0.5 to 10, or more preferably from 1 to 5, because, with this configuration, a high effectiveness in preventing the deformation of a partition plate is obtained, and a high strength of the partition is obtained. For example, the ratio W/T on a one surface of the partition 10 may be constant, or may vary, along the direction in which a rib extends on the surface. In the case where the ratio W/T on a one wall surface of the partition 10 varies along the direction in which a rib extends on that wall surface, the median value (average value) between the largest value and the smallest value of the values of W/T at various positions of the rib on that wall surface of the partition 10 is used as the W/T of the rib on that wall surface of the partition 10. In the case where a plurality of ribs are present on the partition 10, the ratios W/T with respect to the individual ribs may be the same or may be different. Also, the ratios W/T of ribs on wall surfaces that have ribs, of the partition 10 may be the same or may be different.

The thickness T of the partition is the thickness of the partition excluding the ribs.

In the example shown in FIGS. 1 to 3, the ribs 50 and 51 are formed on the wall surfaces on the outer side of the partition 10. This configuration is preferable in that, with this configuration, a decrease in the distance between the partition 10 and the anode 11 due to the presence of the ribs 50 and 51 can be avoided, and thus, nitrogen trifluoride and hydrogen can be prevented from mixing due to excessive nearness of the partition 10 to the anode 11.

It is preferable that, as shown in FIGS. 1 to 3, a plurality of ribs 50 and 51 are provided on the partition 10. Here, the number of ribs is counted in such a manner that, for example, in the case where the partition 10 has a single rib on each of two or more different surfaces thereof, and the ribs on those surfaces are continuous with one another, the continuous ribs count as one. On the other hand, although not shown, in the case where a partition has a single rib on each of two different surfaces thereof, and the ribs on those surfaces are not continuous with each other, the ribs count as two. When a partition has a plurality of ribs, this may mean that a single rib is present on each of different surfaces as described above, but it is preferable that a plurality of ribs are present on a one surface of the partition 10. In light of the ease of production and the improvement of the reinforcing effect for preventing deformation of a partition plate, it is preferable that the number of ribs on a one surface of the partition 10 is from 1 to 10, or more preferably from 1 to 5. Also, in the case where a plurality of ribs are provided on a one surface of the partition 10, it is preferable that a plurality of ribs that extend parallel to one another are present on a one surface of the partition 10, it is also preferable that a plurality of ribs are provided on each of the pair of surfaces 10*a* and 10*b* of the walls that are opposite the pair of plate surfaces 11*a* and 11*b*, respectively, of the electrode, and it is more preferable that a plurality of ribs extending parallel to one another are provided on each of the pair of surfaces 10*a* and 10*b*. Most preferably, two or more ribs that are formed into an annular shape so as to surround the perimeter of the partition 10 are present. Moreover, in the case where a plurality of ribs are provided on a one surface of the partition 10, the number of ribs on that surface is especially preferably from 2 to 5, and most preferably from 3 to 5.

It is preferable that, as shown in FIG. 3, the extending directions of the ribs 50 and 51 are parallel to each other, because, with this configuration, a high partition-reinforcing effect is obtained, but the present invention is not limited to this configuration as will be described later.

A rib may be provided on a lower end of the partition 10, or may be provided at a position that is spaced upward from the lower end.

For example, in the embodiment shown in FIG. 3, the rib 51, which is located the nearest to the lower end portion 10*f*, of a plurality of ribs is provided at a position that is spaced apart from the lower end 10*mf* of the partition 10 toward the upper end portion 10*e* (see FIG. 1), and the other rib 50 is provided on the upper end portion 10*e* side of the rib 51.

It is preferable that the ratio (D1/T) of the distance D1 between a lower end position 51*a* of the rib 51, which is located the nearest to the lower end 10*mf*, and the lower end 10*mf* of the partition to the thickness T of the partition 10 is from 0 to 5, or especially preferably from 0 to 2, because, with this configuration, a high reinforcing effect is obtained.

Note that the lower end 10*mf* of the partition 10 as used in the foregoing description refers to a lower end of a portion of the partition excluding the ribs.

As shown in FIG. 1, the ribs 50 and 51 have a rectangular shape in a side cross-sectional view. However, the shape of the ribs is not limited to this shape, and, for example, a rib may also be formed into a convexly curved surface shape or a triangular shape that protrudes in a standing direction (outward in the direction Z in FIG. 3, with respect to the ribs formed on the surfaces 10*a* and 10*b*) of the rib.

It is preferable that the ratio (H/T) of the height H (see FIG. 3) of a rib to the thickness T of the partition is 0.5 or more, or more preferably 1 or more, because, with this configuration, a high deformation-preventing effect is obtained. Moreover, it is more preferable that the ratio H/T of the height H of a rib to the thickness T of the partition 10 is 5 or less, because, with this configuration, a high strength of the partition is obtained. For example, the ratio H/T on a one surface of the partition 10 may be constant, or may vary, along the direction in which a rib extends on that surface. In the case where the ratio H/T on that surface of the partition 10 varies along the extending direction of the rib, the median value (average value) between the largest value and the smallest value of the values of H/T at various positions of the rib on that surface of the partition 10 is used as the H/T of the rib on that surface of the partition 10. In the case where a plurality of ribs are present on a one surface of the partition 10, the ratios H/T with respect to the individual ribs may be the same or may be different. Moreover, the ratios H/T of ribs on wall surfaces that have ribs, of the partition 10 may be the same or may be different.

In the case where a plurality of ribs are provided on a one surface, it is preferable that the ratio (D2/T) of the distance D2 (see FIG. 3) between the ribs on that surface to the thickness T of the partition is 20 or less, or more preferably 10 or less, because, with this configuration, a high deformation-preventing effect is obtained. Moreover, it is preferable that the ratio D2/T of the inter-rib distance D2 to the thickness T of the partition 10 is 0.1 or more, because, with this configuration, it is easy to provide a large number of ribs, and a high reinforcing effect for preventing deformation of a partition plate is obtained. The ratio D2/T on a one surface of the partition 10 may be constant, or may vary, along a direction in which ribs extend on that surface. In the case where the ratio D2/T on that wall surface of the partition 10 varies along the extending direction of the ribs, the median value (average value) between the largest value and the smallest value of the values of D2/T at various positions on the ribs on that wall surface of the partition 10 is used as the D2/T of the ribs on that wall surface 10*a* of the partition 10. In the case where a plurality of ribs are present on a one surface of the partition 10, the ratios D2/T with respect to the individual ribs may be the same or may be different. Moreover, the ratios D2/T of ribs on surfaces that have ribs, of the partition 10 may be the same or may be different.

It is preferable that the partition 10 does not have a metal material. For example, according to Patent Literature 2, in the collector, the reinforcing ring joint in which a reinforcing metal ring can be inserted is provided on the lower side of the collector, and the reinforcing ring is secured to this reinforcing ring joint. The partition 10 does not have such a metal plate, and thus, it is possible to prevent corrosion of a metal plate, and deformation of the partition, due to permeation of the electrolyte through a portion to which the metal plate is attached. As used herein, the metal material refers to a plate, a rod, a wire, and the like that are attached to an insertion portion of a partition plate as disclosed in Patent Literature 2 or joined to the partition via an adhesive or by welding or the like.

Moreover, it is preferable that the partition 10 does not have another separable fluororesin plate either. The reason for this is that, for example, in the partition of Patent Literature 1, even in the case where a fluororesin plate is included instead of the metal plate, there is a risk that the electrolyte will enter from an insertion portion of the fluororesin plate and cause deformation.

Moreover, in addition to the ribs, a fluororesin material that is formed separately from the partition 10 may also be joined to the partition via an adhesive or by welding or the like. For example, the flange 10*g* (see FIG. 1) may be attached to the partition by welding. Moreover, a partition may also be formed by adopting in which partition plates with which ribs are integrally formed are welded together. However, it is preferable that the partition 10 is formed of an integrally molded product in which members other than the ribs also are not joined in such a manner, because, with this configuration, it is unlikely that deformation due to corrosion by the electrolyte will occur, and a high strength the partition is obtained.

As described above, an embodiment of the present invention has been described based on FIGS. 1 to 3, but the electrolytic cell and the partition of the present invention are not limited to this embodiment.

Figure 4:
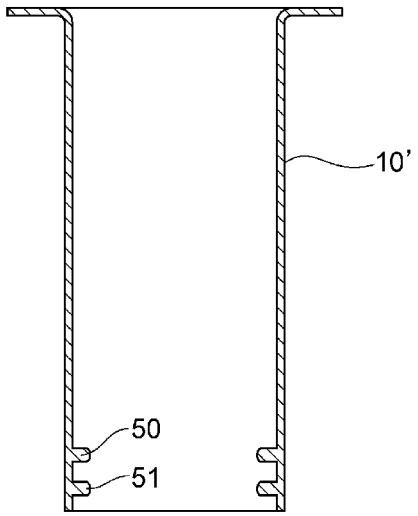
FIG. 4 is a vertical cross-sectional view of a partition of another embodiment taken along a similar position to that of FIG. 1.

For example, as in the case of a partition 10' shown in FIG. 4, the ribs 50 and 51 may be formed on inner surfaces of the partition 10. Also, the ribs 50 and 51 may be formed to have rounded corners.

Figure 5:
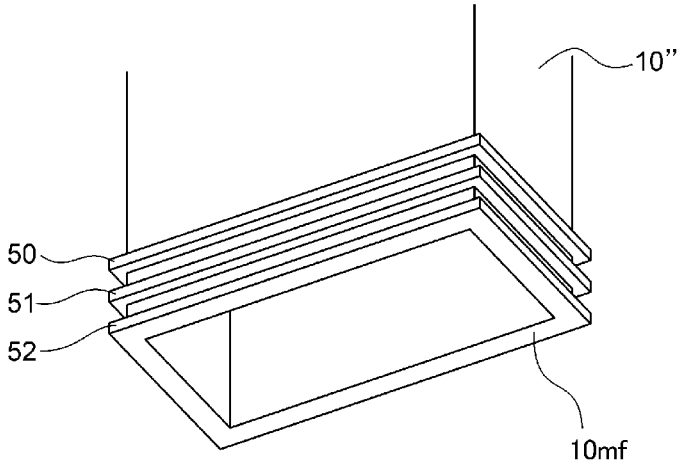
FIG. 5 is a perspective view corresponding to FIG. 3, of a partition of yet another embodiment.

Moreover, for example, as in the case of a partition 10" shown in FIG. 5, a rib 52 that is located on the lowest side may be provided at the same position as the lower end 10*mf* of the partition 10" in the vertical direction Y.

Figure 6:
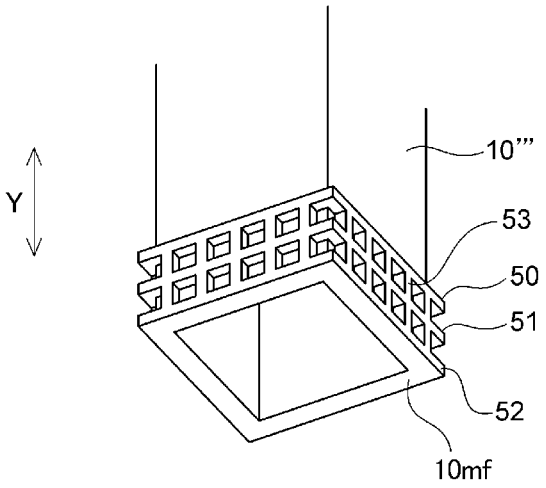
FIG. 6 is a perspective view corresponding to FIG. 3, of a partition of yet another embodiment.
Figure 7:
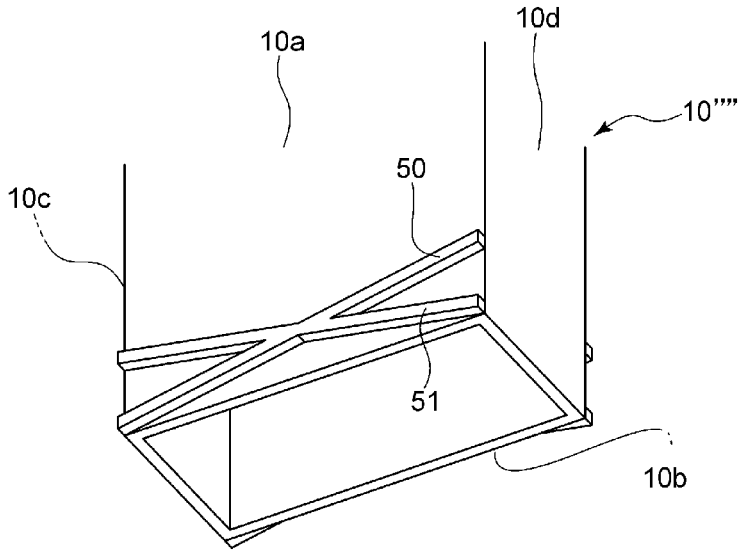
FIG. 7 is a perspective view corresponding to FIG. 3, of a partition of yet another embodiment.

Moreover, for example, in the embodiments shown in FIGS. 1 to 5, the partition has only the ribs extending in a direction that includes a lateral direction component, but instead of this configuration, it is also possible that, as in the case of a partition 10''' shown in FIG. 6, a partition has ribs 53 extending in the vertical direction Y, in addition to the ribs 50, 51, and 52 extending in a direction that includes a lateral direction component. Moreover, depending on the shape of the anode 11, the partition need not have a shape that is elongated in one direction when viewed from below in the vertical direction Y, that is, when viewed from the free end portion 10*f* side, and may be formed into, for example, a substantially square shape as shown in FIG. 6.

Moreover, for example, as shown in FIG. 7, a configuration may also be adopted in which, rather than being provided on each surface of the partition, the ribs 50 and 51 are provided on, for example, only the surfaces 10*a* and 10*b* of the walls that are opposite the plate surfaces of the electrode. The ribs 50 and 51 may not have to be provided on the wall surfaces 10*c* and 10*d* that are opposite the side surfaces of the electrode. Moreover, although a configuration in which the ribs 50 and 51 are parallel to each other as in the foregoing embodiment shown in FIG. 3 has a high reinforcing effect for preventing deformation of a partition plate, the ribs 50 and 51 need not be parallel to each other, and may intersect each other.

The partition of the present invention, which is integrally formed with the ribs, can be easily produced from a fluororesin with use of various molding methods such as injection molding.

The electrolytic cell of the present invention is used to produce nitrogen trifluoride gas by electrolyzing a molten salt containing an ammonium salt and hydrogen fluoride. Iron, steel, nickel, Monel, or the like can be used as an electrode for use in this electrolytic cell.

Any electrolytic cell capable of producing nitrogen trifluoride can be used, and the electrolytic cell need not have any special structure. In order to prevent corrosion and the like of the material of the electrolytic cell by the electrolyte and improve the durability, it is preferable that inner surfaces of the electrolytic cell are coated with a fluororesin such as polytetrafluoroethylene (PTFE) or perfluoroalkoxy alkane (PFA).

Usually, a molten salt containing ammonium fluoride and hydrogen fluoride is used as the electrolyte. Examples of the method for preparing the electrolyte include a method in which the electrolyte is prepared by directly mixing ammonia gas and anhydrous hydrogen fluoride, a method in which the electrolyte is prepared by mixing ammonium fluoride or ammonium hydrogen fluoride and anhydrous hydrogen fluoride, and the like.

With respect to the composition of the electrolyte, it is preferable that the molar ratio of $HF/NH_4F$ is from 1.5 to 2. Setting this molar ratio to be 1.5 or more makes it possible to prevent the electrolytic voltage from increasing and prevent the current efficiency of nitrogen trifluoride production from decreasing, and therefore, is preferable. Also, setting this molar ratio to be 2 or less makes it possible to prevent fluorine gas from being generated, prevent the vapor pressure of HF from increasing, and suppress the amount of loss of HF that is entrained by a generated gas and discharged to the outside of the system, and therefore, is preferable.

When producing nitrogen trifluoride by electrolyzing a molten salt containing an ammonium salt and hydrogen fluoride, with regard to the electrolysis conditions, it is preferable to set the current density at 1 to 20 $A/dm^2$ and the reaction temperature at 100 to 130° C., because, with these electrolysis conditions, it is possible to efficiently produce nitrogen trifluoride.

EXAMPLES

Hereinafter, the present invention will be described in greater detail using examples. However, the present invention is not limited to the examples below.

Example 1

The electrolytic cell shown in FIGS. 1 to 3 was used to produce nitrogen trifluoride. A partition of the embodiment shown in FIGS. 1 to 3 was obtained by integrally molding a polytetrafluoroethylene (PTFE) resin and was used as the partition in the electrolytic cell. The ratio (H/T) of the height H of each rib to the thickness T of the partition was 1.5. The ratio (W/T) of the width W of each rib to the thickness T of the partition 10 was 1. The ratio (D1/T) of the distance D1 between the lower end position 51*a* of the rib 51 located the nearest to the lower end 10*mf*, of the ribs and the lower end 10*mf* of the partition to the thickness T of the partition 10 was 1. The ratio (D2/T) of the inter-rib distance D2 to the thickness T of the partition was 1. Pure nickel with a purity of 99 mass % was used as each of the anode and the cathode. An ammonium fluoride-hydrogen fluoride molten salt $NH_4F.1.8HF$ was prepared from ammonia and anhydrous hydrofluoric acid in the electrolytic cell, and electrolysis was performed at a temperature of 120° C., to thereby produce nitrogen trifluoride. A gas chromatography analysis was performed during the electrolysis, and contamination of an anode gas with hydrogen gas and contamination of a cathode gas with nitrogen trifluoride gas were not observed. Moreover, the partition after an operating time of one month had a shape similar to the shape thereof at the start of the operation, without deformation and the like, and was able to be reused in an electrolytic cell for producing nitrogen trifluoride gas.

Example 2

A similar procedure to that of Example 1 was performed except that the shape of the partition was changed to the shape (D1/T=0, the number of ribs was three) shown in FIG. 5. A gas chromatography analysis was performed during the electrolysis, and contamination of the anode gas with hydrogen gas and contamination of the cathode gas with nitrogen trifluoride gas were not observed. Moreover, the partition plate after an operating time of three months had a shape similar to the shape thereof at the start of the operation, without deformation and the like, and was able to be reused in an electrolytic cell for producing nitrogen trifluoride gas.

Example 3

A similar procedure to that of Example 1 was performed except that the material of the partition was changed to perfluoroalkoxy alkane (PFA). A gas chromatography analysis was performed during the electrolysis, and contamination of the anode gas with hydrogen gas and contamination of the cathode gas with nitrogen trifluoride gas were not observed. Moreover, the partition plate after an operating time of three months had a shape similar to the shape thereof after the operation, without deformation and the like, and was able to be reused in an electrolytic cell for producing nitrogen trifluoride gas.

Example 4

Nitrogen trifluoride was produced in a similar manner to that of Example 1 with use of an electrolytic cell in which a partition of the embodiment shown in FIG. 4 integrally molded from perfluoroalkoxy alkane (PFA) was used as the partition in the electrolytic cell. A gas chromatography analysis was performed during the electrolysis, and contamination of the anode gas with hydrogen gas and contamination of the cathode gas with nitrogen trifluoride gas were not observed. Moreover, the partition plate after an operating time of three months had a shape similar to the shape thereof after the operation, without deformation and the like, and was able to be reused in an electrolytic cell for producing nitrogen trifluoride gas.

Comparative Example 1

An electrolytic cell similar to that of Example 1 was used except that the electrolytic cell had no ribs. After an operating time of 5 hours, contamination of the anode gas with hydrogen gas in an amount of 1 vol % was observed by a gas chromatography analysis, and therefore, the operation was stopped. The partition after stopping the operation had a shape that was deformed such that the lower end 10*mf* of the wall surfaces 10*a* and 10*b* was corrugated, the distances from the electrode plate to the wall surfaces 10*a* and 10*b* were thus increased in the direction Z in FIG. 3, and the effects of the partition were no longer able to be obtained.

INDUSTRIAL APPLICABILITY

With the partition of the present invention, even when the partition is used in an electrolytic cell for producing nitrogen trifluoride for a long period of time, deformation of the partition is effectively suppressed, and the partition can suppress mixing of gases generated from a cathode and an anode, respectively. Also, in the electrolytic cell of the present invention, mixing of the gases respectively generated from the cathode and the anode can be effectively suppressed by using this partition.

The invention claimed is:

1. An electrolytic cell for producing nitrogen trifluoride gas, comprising:

a partition that covers an upper region of one electrode of a cathode and an anode in order to separate a gas generated from the anode and a gas generated from the cathode from each other, wherein the partition has, in a lower end-side region thereof, a plurality of ribs extending in a direction that has a lateral direction component, and the ribs and the partition are made of a fluororesin and are integrally formed.

2. The electrolytic cell as set forth in claim 1, wherein the partition does not have a metal plate or another separable fluororesin plate.

3. The electrolytic cell as set forth in claim 1, wherein the ribs are provided on a surface of the partition that is parallel to a surface of the electrode.

4. The electrolytic cell as set forth in claim 1, wherein the partition and the ribs surround the upper region of the electrode.

5. The electrolytic cell as set forth in claim 1, which has a plurality of ribs on a one surface of the partition.

6. The electrolytic cell as set forth in claim 5, wherein two or more ribs are present, the ribs being formed into an annular shape so as to surround a perimeter of the partition.

7. The electrolytic cell as set forth in claim 1, wherein a ratio (W/T) of a rib width W to a partition thickness T is from 0.5 to 10.

8. The electrolytic cell as set forth in claim 7, wherein the ratio (W/T) of the rib width W to the partition thickness T is from 1 to 5.

9. The electrolytic cell as set forth in claim 1, wherein a ratio (W/T) of a rib height H to a partition thickness T is 0.5 or greater.

10. The electrolytic cell as set forth in claim 9, wherein the ratio (H/T) of the rib height H to the partition thickness T is from 1 to 5.

11. The electrolytic cell as set forth in claim 1, wherein a ratio (D2/T) of an inter-rib distance D2 to a partition thickness T is from 0.1 to 20.

12. The electrolytic cell as set forth in claim 11, wherein the ratio (D2/T) of the inter-rib distance D2 to the partition thickness T is from 0.1 to 10.

13. The electrolytic cell as set forth in claim 1, wherein the ribs are provided at positions that are spaced upward from a lower end of the partition.

14. The electrolytic cell as set forth in claim 13, wherein a ratio (D1/T) of a distance D1 between a lower end of a rib that is located the nearest to the lower end of the partition and the lower end of the partition to a partition thickness T is from 0 to 5.

15. A partition for an electrolytic cell for producing nitrogen trifluoride gas, the partition being configured to be used to cover an upper region of one electrode of an anode and a cathode of the electrolytic cell for producing nitrogen trifluoride gas, wherein the partition is used with one end side thereof being fixed to an upper portion of the electrolytic cell, and has, on a wall surface on another end side thereof, a plurality of ribs extending in a direction that has a direction component that is perpendicular to a direction in which the two end portions are opposite each other, and the partition is made of a fluororesin and is integrally formed with the ribs.

16. The electrolytic cell as set forth in claim 1, wherein the ribs and the partition are integrally formed by integrally molding.

17. The electrolytic cell as set forth in claim 1, wherein the plurality of ribs are different in a distance D1 to a lower end of the partition.

18. The electrolytic cell as set forth in claim 16, wherein the plurality of ribs are different in a distance D1 to a lower end of the partition.

19. The electrolytic cell as set forth in claim 5, wherein the plurality of ribs on the one surface of the partition extend parallel to one another.

20. The electrolytic cell as set forth in claim 1, wherein the partition has four inner surfaces surrounding the electrode and four outer surfaces respectively paired with the four inner surfaces, and at least one of the four inner surfaces and the four outer surfaces has a plurality of ribs.

21. The electrolytic cell as set forth in claim 20, wherein the plurality of ribs and the partition are integrally formed, without attaching the plurality of ribs to the partition by welding.

* * * * *